United States Patent [19]

Madonna et al.

[11] Patent Number: 4,957,237

[45] Date of Patent: Sep. 18, 1990

[54] BOX WITH INTERNAL PLATFORM FOR VERTICAL STACKING OF PRODUCTS

[75] Inventors: Louis Madonna, Toronto; Chris Garrett, Mississauga, both of Canada

[73] Assignee: Paperboard Industries Corporation, Mississauga, Canada

[21] Appl. No.: 442,672

[22] Filed: Nov. 29, 1989

[51] Int. Cl.[5] ..... B65D 5/48

[52] U.S. Cl. ..... 229/120; 206/45.19; 229/120.21; 229/906; 229/DIG. 14

[58] Field of Search ..... 229/120.13, 120.21, 229/178, 902, 903, 120, 906, DIG. 14, 2.5 R; 206/45, 19; 426/115, 119, 128

[56] References Cited

U.S. PATENT DOCUMENTS

| | | | |
|---|---|---|---|
| Re. 29,415 | 9/1977 | Ricobene et al. | 229/2.5 R |
| D. 274,889 | 7/1984 | Sullivan | 229/2.5 R |
| 1,352,759 | 9/1920 | Markert | 229/120.21 |
| 2,303,264 | 11/1942 | Flick | 206/45.19 |
| 2,366,557 | 1/1945 | Rau | 229/120.21 |
| 2,375,843 | 5/1945 | Gottlieb | 229/120.18 |
| 2,850,224 | 9/1958 | Meinhardt et al. | 229/120.21 |
| 2,948,455 | 8/1960 | Frankenstein | 229/120.21 |
| 3,095,086 | 6/1963 | Berg | 206/45.19 |
| 3,899,119 | 8/1975 | Roccaforte | 229/178 |
| 4,301,960 | 11/1981 | Alexander et al. | 229/906 |
| 4,441,626 | 4/1984 | Hall | 229/902 |
| 4,836,383 | 6/1989 | Gordon et al. | 229/120.21 |

*Primary Examiner*—Gary E. Elkins

[57] ABSTRACT

The present invention provides a box with internal stacking capacity and particularly useful for the stacking of different food products such as pizzas and the like. The box itself comprises a base, a top and at least one internal platform with downwardly extending platform walls which space the platform above the base and below the top for vertical stacking of the products interiorly of the box. The platform is hingedly secured to the box for lifting the platform out of the way and exposing the box base with the platform still remaining attached to the box. The platform attachment then provides a guide for refitting of the platform back into the box.

9 Claims, 7 Drawing Sheets

BOX WITH INTERNAL PLATFORM FOR VERTICAL STACKING OF PRODUCTS

FIELD OF THE INVENTION

The present invention relates to a box with a movable interior platform for the vertical stacking of products and in particular, food products interiorly of the box.

BACKGROUND OF THE INVENTION

In view of the competitive nature of the pizza industry, some pizza companies now offer two pizzas for the price of one. The traditional packaging for these two pizzas is in the form of an elongated box where the pizzas sit side by side with one another. These boxes become extremely cumbersome particularly if one purchases a large or a party size pizza further increasing the side by side style box dimensions.

In another food area, one will often purchase two or more pies, cakes, etc. at one time. These food products are typically packaged in individual boxes because there is presently no convenient way of packing a plurality of pies or the like in a single box without damaging the pies.

SUMMARY OF THE PRESENT INVENTION

The present invention provides a box which, although useful in other areas, is particularly useful for the packaging of a plurality of food type products. The box of the present invention is one which has an internal vertical stacking capacity and comprises a base, a top and at least one platform, between the top and the base. The platform is provided with downwardly extending spacing means which spaces the platform above the base and below the top thereby leaving two spacing cavities, one above and one below the platform. These spacing cavities are used for the vertical stacking of products and in particular, food products interiorly of the box.

One of the keys of the present invention is that the platform is movably secured to the box for lifting the platform out of the way and exposing the box base beneath the platform with the platform remaining attached at all times to the box. The attachment means for the platform then provides a guide for refitting of the platform back into the box. According to an aspect of the present invention, the box is specifically designed for the vertical stacking of pizzas and overcomes the problems associated with much larger boxes presently used for the side by side sale of pizzas sold on a two for one basis.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 8:
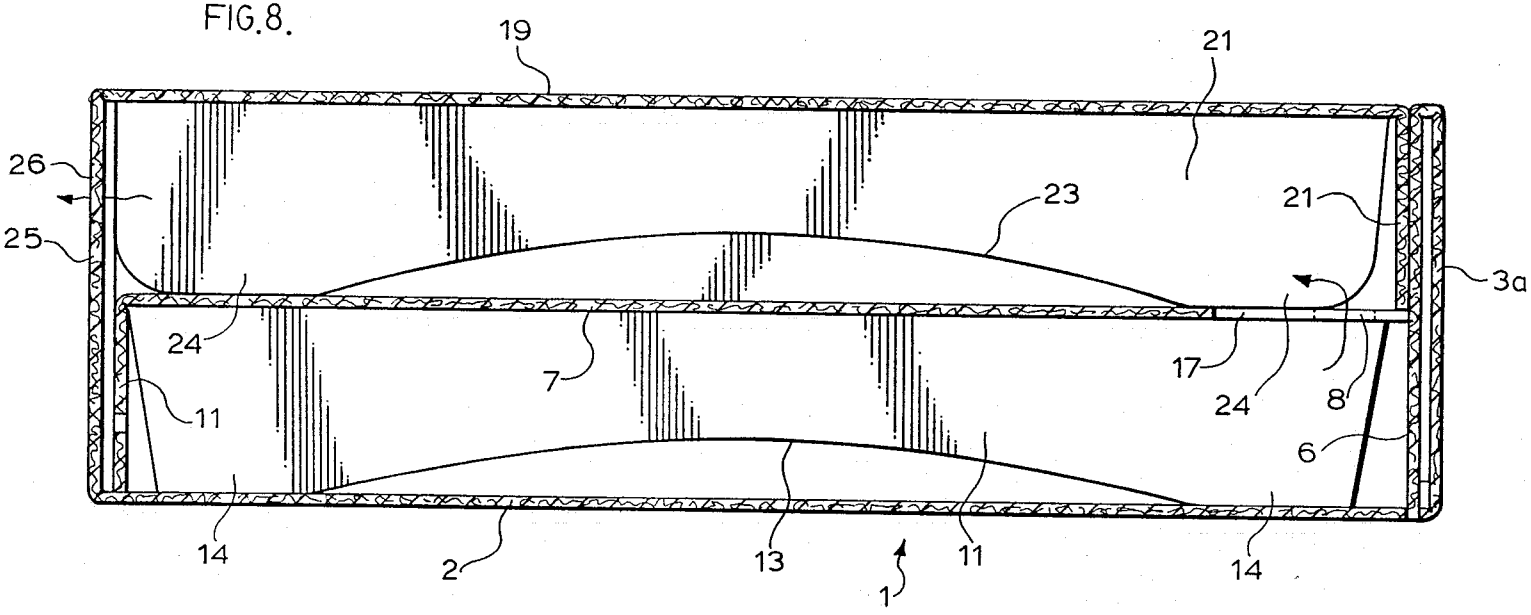
FIG. 8 is a sectional view looking through the assembled and closed box of FIG. 4.

FIGS. 1 through 4 show a box with internal stacking capacity generally indicated at 1. This box is specifically designed for the vertical stacking of pizzas commonly sold in the pizza industry on a two for one basis or simply for the sale of more than one pizza. The unique feature of this box over and above a conventional pizza box is the provision of an internal platform 7 which, as best seen in FIG. 8 of the drawings, provides two separate cavities or product receiving regions, one beneath the platform and one above the platform. The two pizzas are placed in these two product receiving regions.

Figure 5:
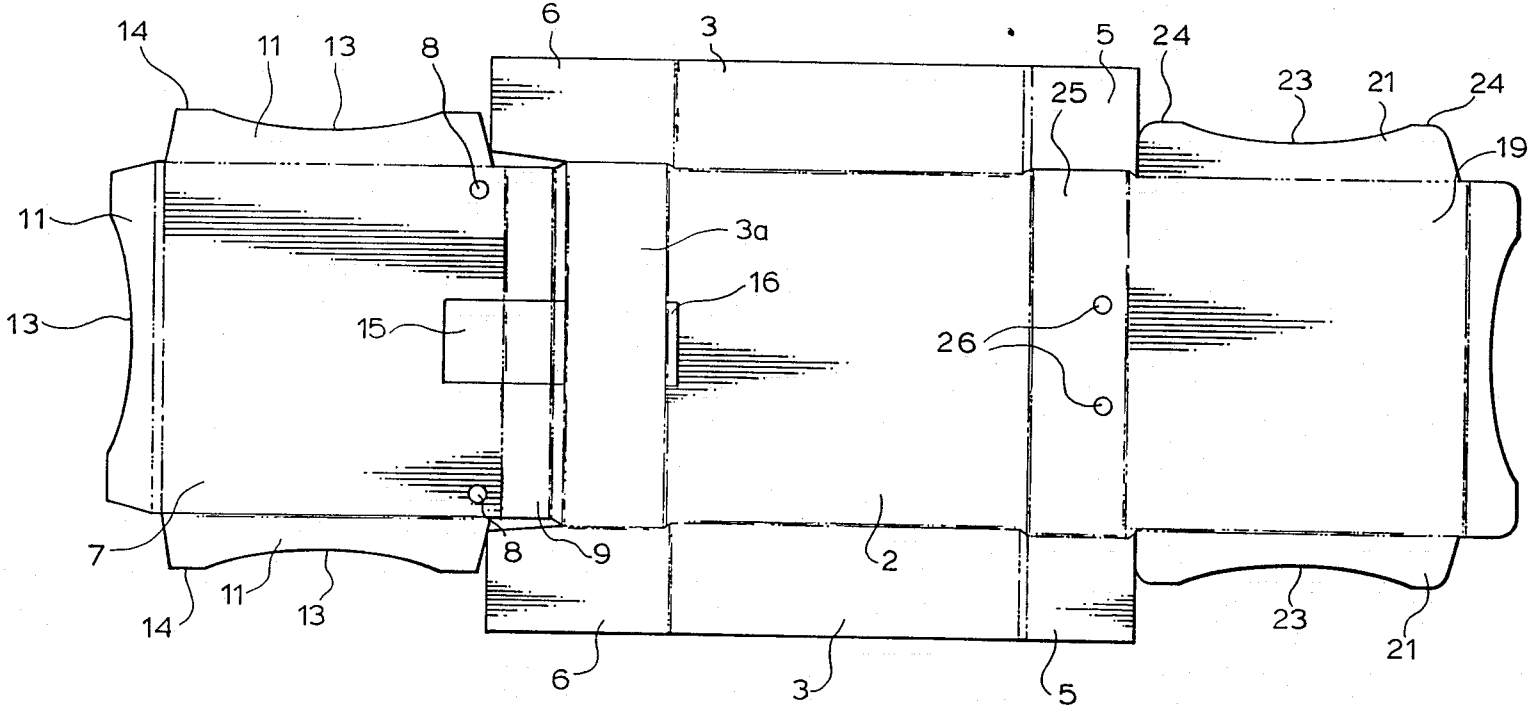
FIG. 5 is a top view looking down on a box blank used to make the box of FIGS. 1 through 4.
Figure 6:
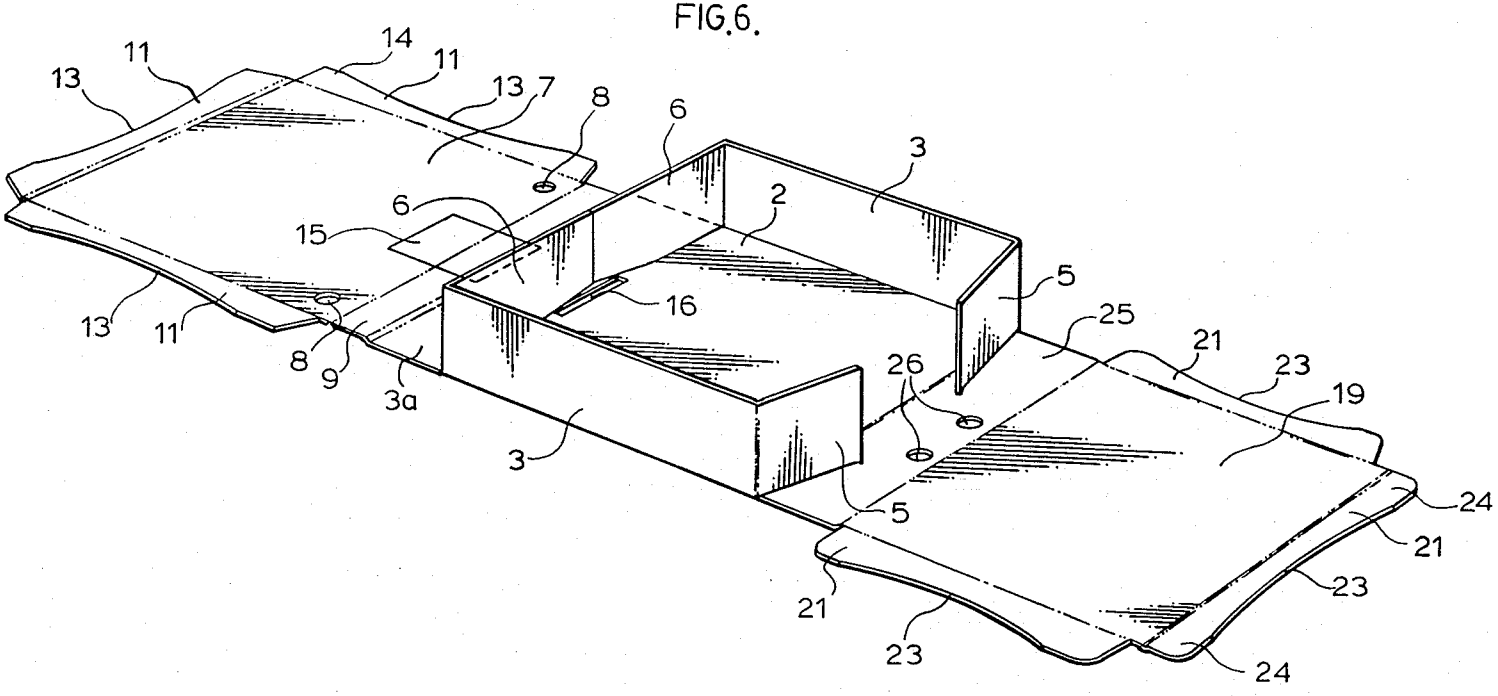
FIGS. 6 and 7 show the assembly of the box blank shown in FIG. 5.
Figure 7:
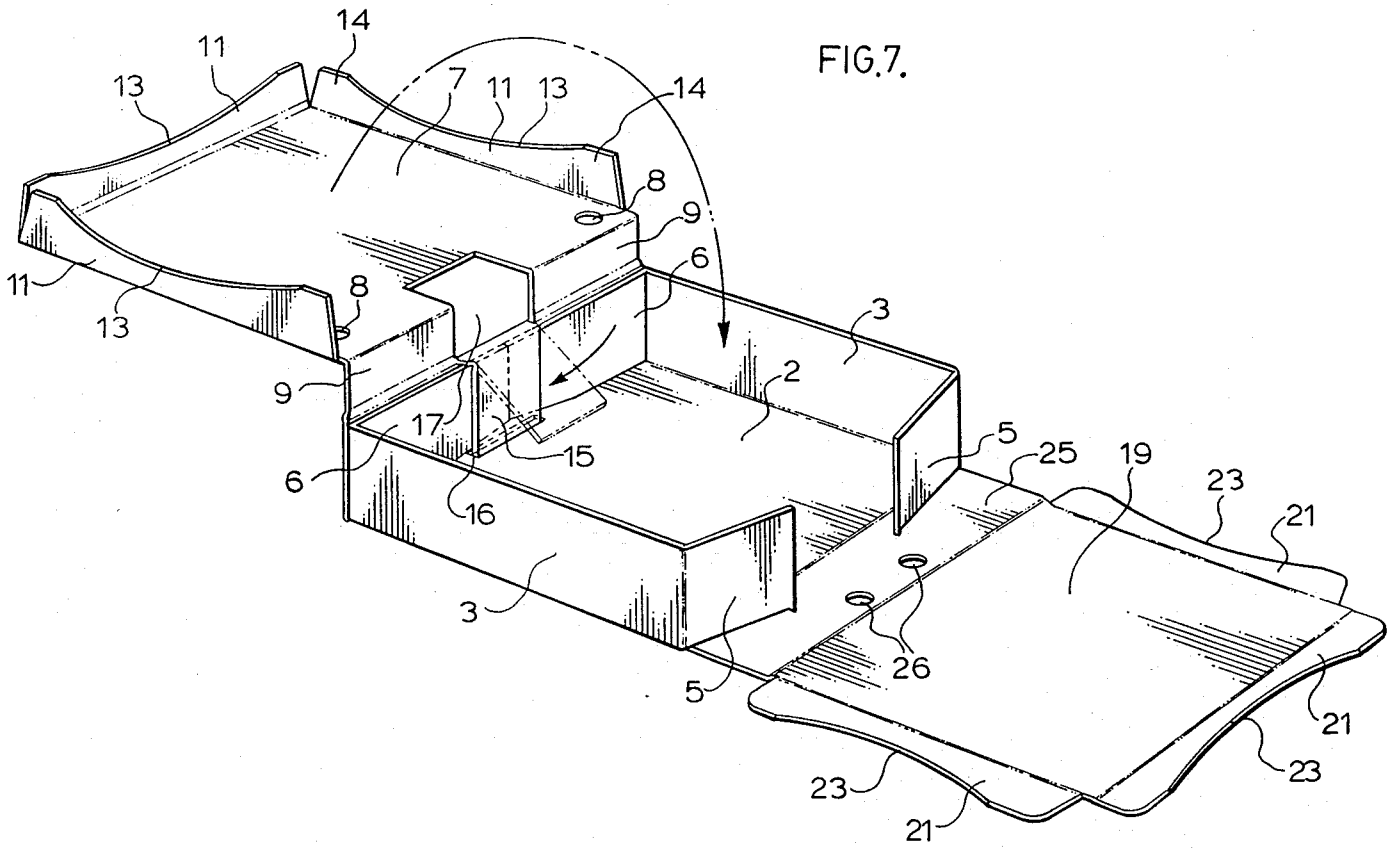

The construction of the box is best described having reference to FIGS. 5 through 7 of the drawings which show the assembly of the blank from which the box is made. This blank includes a box base 2 having opposing sidewall portions 3 and further opposing sidewall portions **3*a* and 25. Extending at opposite ends of the two sidewall portions 3 are flaps 5 and 6. Flap portion 9 which forms a platform attachment to the box is movably or hingedly secured to sidewall portion 3*a* and platform 7 is in turn movably or hingedly secured to flap portion 9**.

Located at the opposite end of the blank from the platform is a box top 19 hingedly secured to sidewall portion 25.

Platform 7 includes platform wall forming flaps 11 which are bendable at 90° relative to the platform while box top 19 includes similar flaps 21 again bendable at 90° relative to the box top.

A tab 15 is prescored extending from sidewall portion **3*a* through flap portion 9 and into the platform 7. During the assembly of the blank, this tab is punched out leaving a tab opening 17 seen for example in FIG. 1 of the drawings. The base of the box 2 is provided with a recess 16 for receiving tab 15** after it has been punched out from its prescored position.

FIG. 6 shows the initial assembly of the box where the side walls 3 are bent upwardly at right angles to the base 2. The flaps 5 and the flaps 6 are bent inwardly relative to the sidewalls 3. Note that the flaps 6 extend all the way across the one end of the box while flaps 5 do not cover the other end of the box.

As seen in FIG. 7, tab 15 is punched out of the box blank and the side wall **3*a* is bent upwardly at 90° relative to base 2. Tab 15 is then bent downwardly over the two flaps 6 and locks into the tab recess 16 to both hold sidewall 3*a* in its upright position and secure the one end of the box. From here, flaps 11** are bent inwardly at right angles to the platform 7 and the platform itself is bent outwardly at right angles to flap portion 9.

Although not shown in FIG. 7, the next step is the inward bending of flaps 21 relative to the box top 19 so that it then takes on the same general configuration as platform 7.

Figure 1:
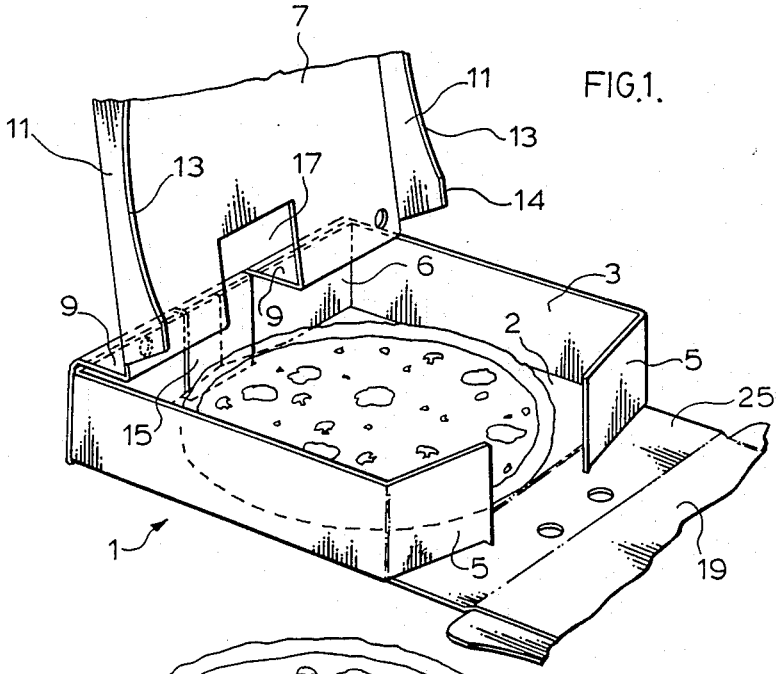
FIG. 1 is a perspective view looking down on an opened box including a vertical stacking platform shown in an out of the way position with the box being used for the vertical stacking of pizzas according to a preferred embodiment of the present invention.
Figure 2:
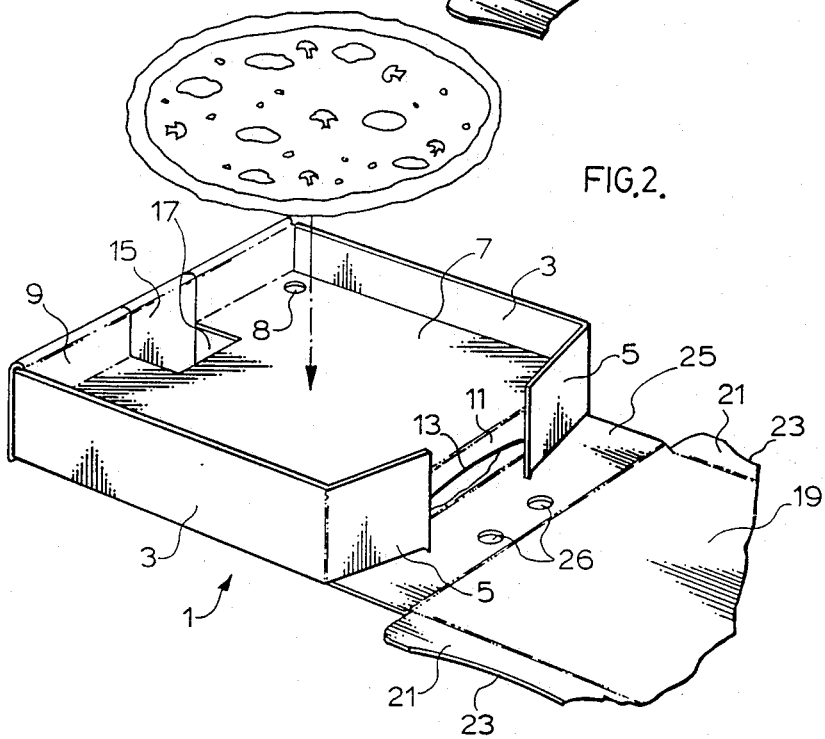
FIG. 2 is a further perspective view looking down on the box of FIG. 1 with the vertical stacking platform in its use position.
Figure 3:
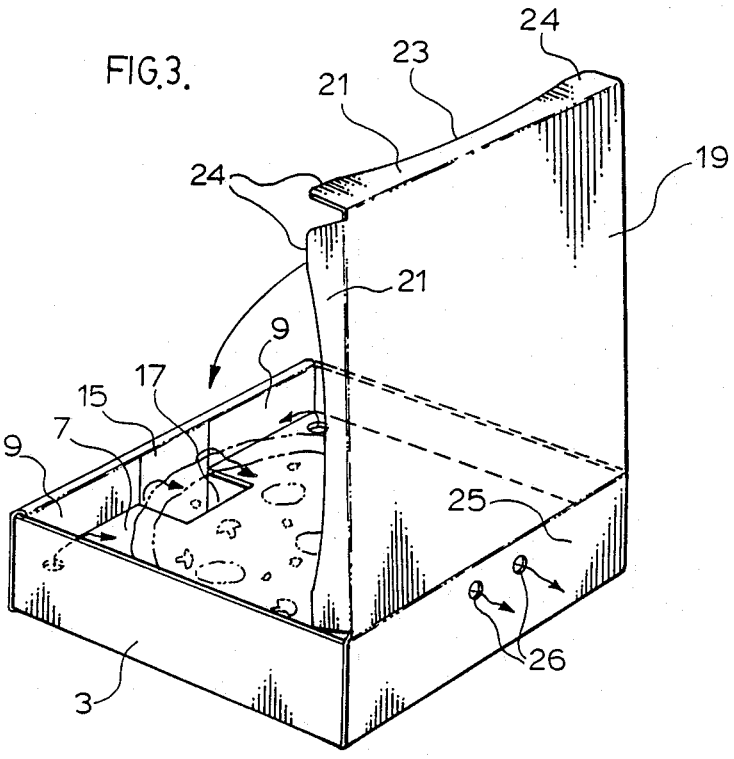
FIG. 3 is a further perspective view of the box shown in FIG. 1, again with the platform in the use position and showing the top of the box in an open position.
Figure 4:
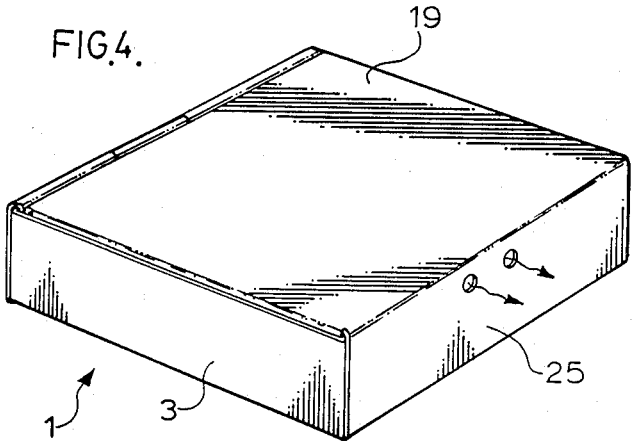
FIG. 4 is a perspective view of the box shown in FIG. 3 with the top in a closed position.

Returning to FIG. 1, platform 7 is moved to its use or operating position by bending the flap 9 downwardly over flaps 6 with the side flaps 11 remaining in their downwardly bent positions so that the platform then assumes the FIG. 2 set up. From here in order to close the box, sidewall portion 25 is bent upwardly at 90° relative to the base of the box and to the outside of flaps 5 and then the top 19 is bent inwardly at the upper end of sidewall 25 to close the box with the top flaps 21 bent to their downward position relative to the box top. Flaps 21 fit to the inside of the box sidewalls as shown in FIG. 8 of the drawings.

The actual useage of the box is best seen again referring to FIGS. 1 and 2 of the drawings. With the platform 7 lifted up and out of the way, but still secured to the box by means of hinge flap 9, a first pizza is loaded into the box directly on the box base 2. From here, platform 7 is bent downwardly and inwardly where the hinge flap 9 provides a guide for the fitting of the platform. The flaps 11 to the outside of the platform sit on the box base 2 as best seen in FIG. 8. These flaps therefore provide support spacers preventing the platform from moving down directly on the top of the already loaded pizza as seen in FIG. 2 of the drawings. A second pizza is then loaded directly on top of the supported platform at which point the box top is closed over the top pizza and again prevented from moving downwardly too far by means of its spacer flaps 21 which sit on the top of the platform 7 as seen in FIG. 8 of the drawings.

A number of further features have been added to the box to accommodate the fitting of pizzas and in particular, hot pizzas in the box. Firstly, sidewall flaps 11 on the platform 7 include upwardly arched regions 13 to accommodate the round edged contour of the lower pizza which is then able to tightly fit within the confines of the box with the pizza edge extending through the upwardly arched regions. Note that it is the portions 14 of flaps 11 to the opposite ends of the arched regions that provide the vertical stacking support for the platform.

Each of the flaps 21 on the box top include a similar upwardly arched region 23 with support portions 24 once again to accommodate the round edge of the top loaded pizza.

In addition, the box is provided with venting means to air out the box from hot moist vapour given off by a hot pizza. A natural vent is provided by the tab opening 17 and additional vents 8 are provided in the platform 7. Further vents 26 are provided in flap 25 and as seen in FIG. 8 of the drawings, vents 26 are located above platform 7 when the box top is closed. With this venting arrangement vapours from the lower pizza are able to pass upwardly through tab opening 17 as well as the vents 8 to the upper storage region and those vapours as well as vapours given off by the upper pizza then move outwardly of the box through the vent openings 26.

Figure 9:
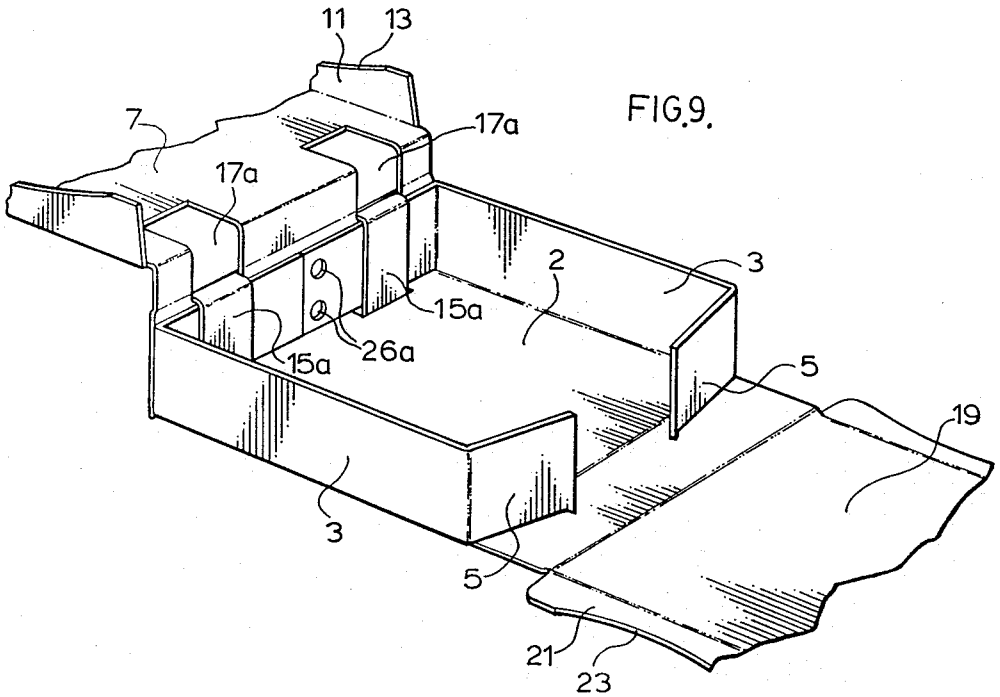
FIG. 9 is a perspective view of an alternate box according to a further preferred embodiment of the present invention.

In the embodiment shown in FIG. 9 of the drawings, the box blank has substantially the same construction as that shown for example in FIG. 7, with the exception that in FIG. 9, the box blank includes two tabs 15*a* and two corresponding tab or vent openings 17*a*. In this embodiment tab or vent openings 17*a* are off center of the box and provide sufficient venting from the lower to the upper compartment so as to eliminate the requirement of any further vent openings through the platform.

A further difference in the embodiment of FIG. 9 is the inclusion of vent openings 26*a* in replacement of vent openings 26. When the internal platform is lowered, the lower of the two vent openings 26*a* is positioned below the platform while the upper of the two vent openings 26*a* is positioned above the platform for respective venting of the upper and lower compartments. paperboard. Furthermore, it is to be appreciated that although specific reference has been made to the use of the box for receiving pizzas, other food items such as pies and the like can equally as well be fitted into the box. In addition, the box including an internal platform can also be used for the packaging of non-food related products where it is desirable for vertical separation of those products.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A box for use in carrying hot food products with internal stacking capacity and comprising a base, a box sidewall extending upwardly from said base, a top fittable with said box sidewall to close said box and at least one platform outwardly covered by said box sidewall, said platform having downwardly extending spacing means for spacing said platform above said base and below said top when said top is closed for vertical stacking of products in said box, said platform being movably secured to said box for lifting said platform and exposing said base with said platform remaining attached to said box, said box being provided with venting holes through said platform and interiorly of said box and through said box sidewall to the exterior of said box.

2. A box as claimed in claim 1, wherein said top is movably secured to said box such that said top when opened remains attached to said box, said top and said platform being secured at opposite ends of said box.

3. A box as claimed in claim 1, wherein said spacing means comprises a platform sidewall extending downwardly from said platform internally of and against said box sidewall.

4. A box as claimed in claim 1, formed from a box blank including at least one locking tab for holding said box in an assembled condition with said platform having a secured end and a free end and said locking tab forming a cut-out region in and providing an air passage through said platform at said secured end thereof.

5. A box as claimed in claim 1, wherein said platform defines upper and lower compartments in said box, said venting holes being provided in said sidewall and positioned with at least one venting hole above and one venting hole below said platform from said upper and lower compartments respectively.

6. A box with internal stacking capacity and comprising a base, a box sidewall extending upwardly from said base, a top fittable with said box sidewall to close said box and at least one platform outwardly covered by said box sidewall, said platform having downwardly extending spacing means for spacing said platform above said base and below said top when said top is closed for vertical stacking of products in said box, said platform being movably secured to said box for lifting said platform and exposing said base with said platform remaining attached to said box, said box being formed from a box blank including at least one locking tab for locking said box in an assembled condition with said platform having a secured end and a free end and said locking tab forming a cut out region in and providing an air passage through said platform at said secured end thereof.

7. A box as claimed in claim 6, wherein said platform sidewall includes upwardly arched regions therearound for fitting a product with a round edge tightly inside of said box the round edge of the product extending through said upwardly arched regions to said box sidewall.

8. A box as claimed in claim 6, including a plurality of locking tabs, said locking tabs forming a corresponding plurality of cut out regions which are located off center and along said secured end of said platform.

9. A box as claimed in claim 6, wherein said platform is secured to said box by a hinge flap, said hinge flap forming a guide for positioning of said platform in said box.

* * * * *